US005992853A

United States Patent [19]

Rudell et al.

[11] Patent Number: 5,992,853

[45] **Date of Patent: *Nov. 30, 1999**

[54] GAME WITH TIMED WATER RELEASE

[75] Inventors: Elliot Rudell, Torrance; Joseph Cernansky, Palos Verdes Estates, both of Calif.

[73] Assignee: Elliot A. Rudell, Torrance, Calif.

[ * ] Notice: This patent is subject to a terminal disclaimer.

[21] Appl. No.: 09/033,319

[22] Filed: Mar. 2, 1998

Related U.S. Application Data

[63] Continuation-in-part of application No. 08/790,728, Jan. 27, 1997, Pat. No. 5,722,660.

[51] Int. Cl.[6] ..... A63F 3/00

[52] U.S. Cl. ..... 273/287; 273/432; 273/148 R

[58] Field of Search ..... 273/243, 241, 273/148 R, 287, 429, 430, 431, 432

[56] References Cited

U.S. PATENT DOCUMENTS 4,113,259 9/1978 Sands ..... 273/241

5,429,369 7/1995 Hurst ..... 273/243

*Primary Examiner*—William M. Pierce

*Attorney, Agent, or Firm*—Blakely Sokoloff Taylor & Zafman

[57] ABSTRACT

A game wherein a player is sprayed with water if the player does not correctly answer a question within a time interval. The game may include a spray unit and an electronic visual display that are attached to a housing. The spray unit and visual display are connected to a controller circuit. The controller circuit may generate a question that is displayed by the visual display. The question can be provided to a player of the game. Alternatively, the game may have a speaker so that the question is provided to the player in an audible form. The game may initiate a timer when the question is displayed. The controller circuit can actuate the spray unit to spray a fluid onto the player if the player does not correctly answer the question within a time interval. The game may also have a reset switch which can reset the timer if a correct answer is provided within the time interval. If a correct answer is provided by the first player the same question can be provided to a second player and so forth and so on.

7 Claims, 3 Drawing Sheets

GAME WITH TIMED WATER RELEASE

CROSS-REFERENCE TO RELATED APPLICATIONS

This application is a continuation-in-part of application Ser. No. 08/790,728, filed Jan. 27, 1997, now U.S. Pat. No. 5,722,660.

BACKGROUND OF THE INVENTION

1. Field of the Invention

The present invention relates to a game wherein a player is squirted with water if the player does not correctly answer a question within a time interval.

2. Description of Related Art

There have been developed a number of social activity games which require group participation. For example, there has been marketed a game under the trademark TRIVIAL PURSUIT wherein a player or team of players must correctly answer questions to move a token about a board.

U.S. Pat. No. 5,429,369 issued to Hurst discloses a game board which has a water spray device that is attached to the board. The game requires that a player correctly answer a question printed on a card provided with the game. Another player may actuate a pump and spray the player with the spray device if the player provides an incorrect answer.

U.S. Pat. No. 4,113,259 issued to Sands is a game board which also has a water spray device. The players take turns moving a token across the game board in accordance with instructions provided by a spinning dial. When a player reaches a certain position on the board, the player can actuate the spray device to spray another player.

U.S. Pat. No. 4,526,366 issued to Kenoun discloses an electronic water game that contains a turret which pivots about a stationary base. Each player position of the turret has a nozzle, a light and a switch. The switches are manipulated to spray water onto the other players, and to block water from being sprayed onto the player.

U.S. Pat. Nos. 4,890,838 and 4,991,847 issued to Rudell disclose a time released water toy. The Rudell toy includes two molded shells that form a foraminous ball that is assembled over a water filled balloon. Players pass the balloon filled ball to each other. The ball also contains an internal resettable timer that punctures the balloon when the timer times out. Puncturing the balloon releases water onto the player holding the ball.

U.S. Pat. Nos. 4,813,680 and 5,263,714 issued to Rudell disclose water release games which have members that can be selected to release or prevent the release of water.

Pressman Toys introduced "HYDRO STRIKE," a skill and action tabletop game for two players that involved opponents sitting at opposite ends of a molded game base and playing a double-ended pinball game against one another. Whenever a player successfully caused a ball to hit an opponent's target, a circuit was activated to emit a spray of water on the opponent.

Pressman has introduced a handheld game that requires a player to hold the unit and systematically press buttons to duplicate a lit pattern generated by the handheld unit. Failure to correctly press the buttons results in the player holding the unit getting himself sprayed.

Mattel Toys released a line of small keychain-sized LCD devices called "Thinklings" that display on their LCD screen scrolling trivia questions and then display the answers. As this product is positioned as "useless knowledge" for conversation and personal enjoyment, there is no provision for gamplay nor for any reward or penalty for correct or incorrect answers.

SUMMARY OF THE INVENTION

One embodiment of the present invention is a game wherein a player is sprayed with water if the player does not correctly answer a question within a time interval. The game may include a spray unit and an electronic visual display that are attached to a housing. The spray unit and visual display are connected to a controller circuit. The controller circuit may generate a question that is displayed by the visual display. The question can be provided to a player of the game. The controller circuit can actuate the spray unit to spray a fluid onto the player if the player does not correctly answer the question within a time interval.

DETAILED DESCRIPTION OF THE INVENTION

One embodiment of the present invention is a game wherein a player is sprayed with water if the player does not correctly answer a question within a time interval. The game may include a spray unit and an electronic visual display that are attached to a housing. The spray unit and visual display are connected to a controller circuit. The controller circuit may generate a question that is displayed by the visual display. The question can be provided to a player of the game. Alternatively, the game may have a speaker so that the question is provided to the player in an audible form. The game may initiate a timer when the question is displayed. The controller circuit can actuate the spray unit to spray a fluid onto the player if the player does not correctly answer the question within a time interval. The game may also have a reset switch which can reset the timer if a correct answer is provided within the time interval. If a correct answer is provided by the first player the same question can be provided to a second player and so forth and so on.

Figure 1:
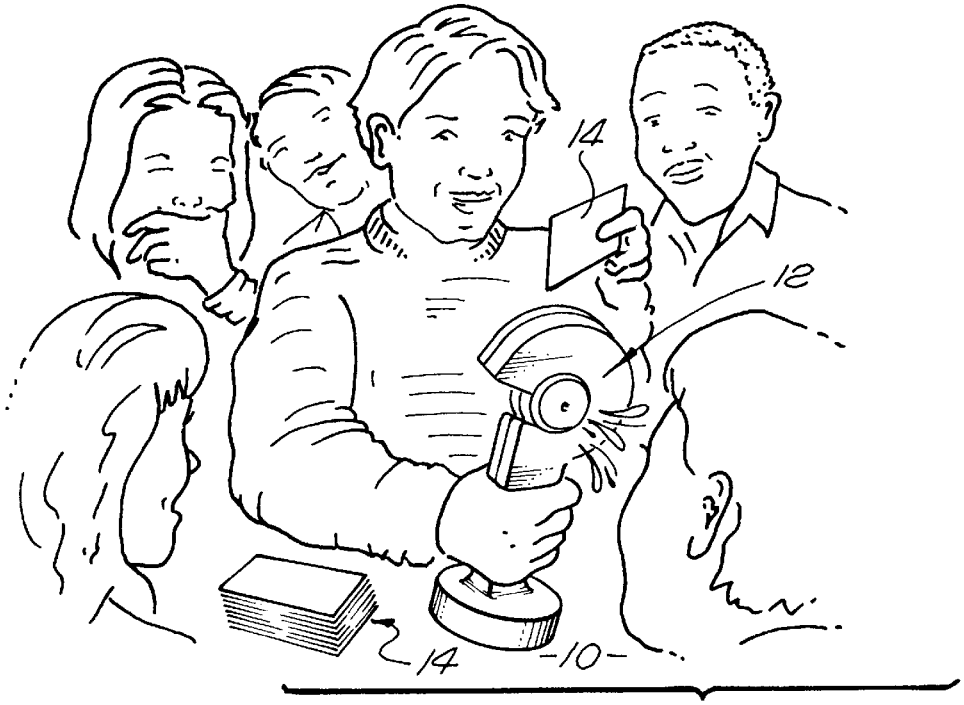
FIG. 1 is a perspective view showing a number of players performing the game of the present invention.

Referring to the drawings more particularly by reference numbers, FIG. 1 shows a game 10 of the present invention. The game 10 includes a spray unit 12 and a deck of cards 14. Each card 14 has at least one question that can be provided to the other players in accordance with the game method of the present invention. In the preferred embodiment there are 52 cards in a deck. The spray unit 12 includes a manually activated resettable timer assembly that releases water onto a player when activated and not reset within a time interval.

To play the game the spray unit 12 is filled with a fluid such as water and the players form a circle about a "question" player. The question player selects one card 14 from the deck of cards. The question player then activates the timer of the spray unit 12 and asks one of the players a question from the selected card 14. The player then attempts to correctly answer the question. If the player provides a correct response within the time interval the question player resets the timer and asks the next player the question. If the player does not provide a correct response within the time interval the spray unit 12 releases the water. The question player holds the spray unit 12 adjacent to the player so that the water is sprayed onto the player as a penalty for not correctly responding to the question.

After being sprayed, the sprayed player takes the card and moves to the center of the circle to become the new question player. The old question player then becomes a participant who answers questions. The new question player selects a card 14 from the deck, sets the timer and provides a question to one of the other players. The questioned player must correctly answer the question or be squirted with water.

Correctly answering a question moves the question to an adjacent player in the circle. The subsequent players cannot use an answer of a previous player. For example, if the question is to name a professional baseball team and the first player correctly responds "Los Angeles Dodgers", the next player must name a team other than the Dodgers. If all of the players provide a correct answer within the time interval a new card is selected and the process is repeated. Each time a player does not provide a correct answer within the time interval the player is squirted and must hold the selected card. The game is played until all of the cards are removed from the deck and held by the players. The player with the least amount of cards wins the game.

If two or more people have the lowest number of cards, an elimination round is performed to determine a winner. The players with the lowest number of cards sit in a circle and a designated question player selects a card, sets the timer assembly and provides a question for the players. A player who does not correctly answer the question within the time interval is eliminated from the game. This process continues until only one player remains. The remaining player wins the game.

Two or more players may state that the question is too hard and request a new question. Additionally, the question player can challenge the correctness of an answer. The player can respond with a new correct answer before the timer times out. If the timer expires before a correct response is provided and the player subsequently proves that the challenged answer is correct, the sprayed player become the new question player, but the question player that challenged the question must take the card.

Figure 2:
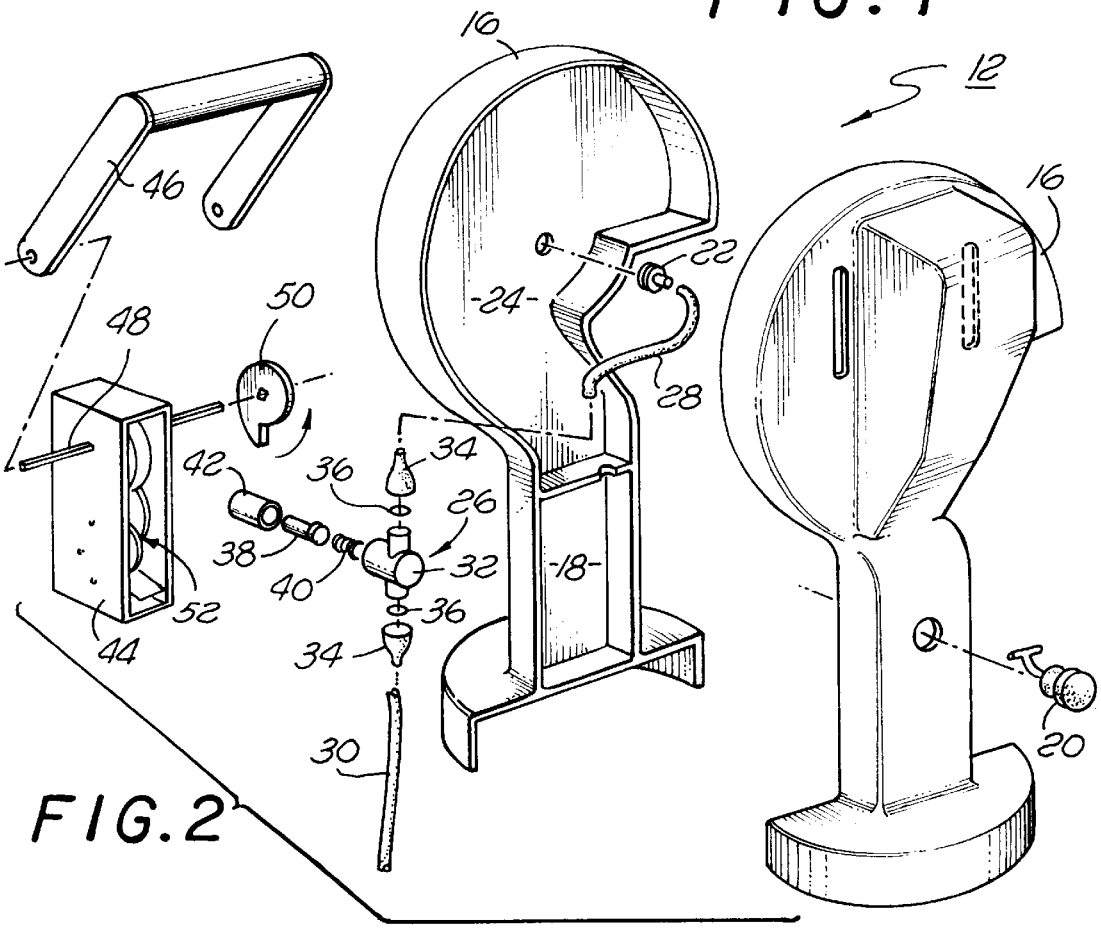
FIG. 2 is an exploded view of a spray unit of the game.

FIG. 2 shows a spray unit 12. The unit 12 includes a housing 16 that is preferably constructed from two molded pieces. The spray unit 12 is light and portable so that the unit 12 can be held by a child. The housing 16 includes a reservoir 18 that can be filled with water through a fill plug 20.

The spray unit 12 has a nozzle 22 attached to the housing 16 in an upper chamber 24. The nozzle 22 is coupled to the reservoir 18 by a pump assembly 26 and a pair of tubes 28 and 30. The pump assembly 26 includes a pump chamber 32 that is connected to the tubes 28 and 30 by a pair of adapters 34 and seals 36. Located within the pump chamber 32 is a piston 38 and a return spring 40. The piston 38 is captured by a sleeve 42. Movement of the piston 38 pushes water within the pump chamber 32 through the nozzle 22. The pump chamber 32 preferably contains a pair of one-way check valves to prevent the water within the pump chamber 32 from being pushed back into the reservoir 18.

Also located within the upper chamber 24 is a gear driven timer 44 that is activated by rotating a handle 46. The handle 46 is coupled to the timer 44 by a shaft 48. The shaft 48 is also connected to a cam 50. When the timer 44 is activated by rotation of the handle 46 the internal timer gears 52 move while the shaft 48 remains stationary. After a certain timer interval the timer gears reach a position wherein the shaft 48 and cam 50 are rotated in a counterclockwise direction. Rotation of the cam 50 pushes the piston 38 and squirts water from the nozzle 22 of the unit. The spray unit 12 can be reset by rotating the handle 46. Rotating the handle 46 before the time interval prevents water from being released from the unit 12.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, instead of a mechanical timer the spray unit may incorporate an electrical timer that is activated by a button. The timer may be connected to a sound device and light emitting diodes (LEDs) which emit sounds and light that provide an indication of the countdown of the timer.

Figure 3:
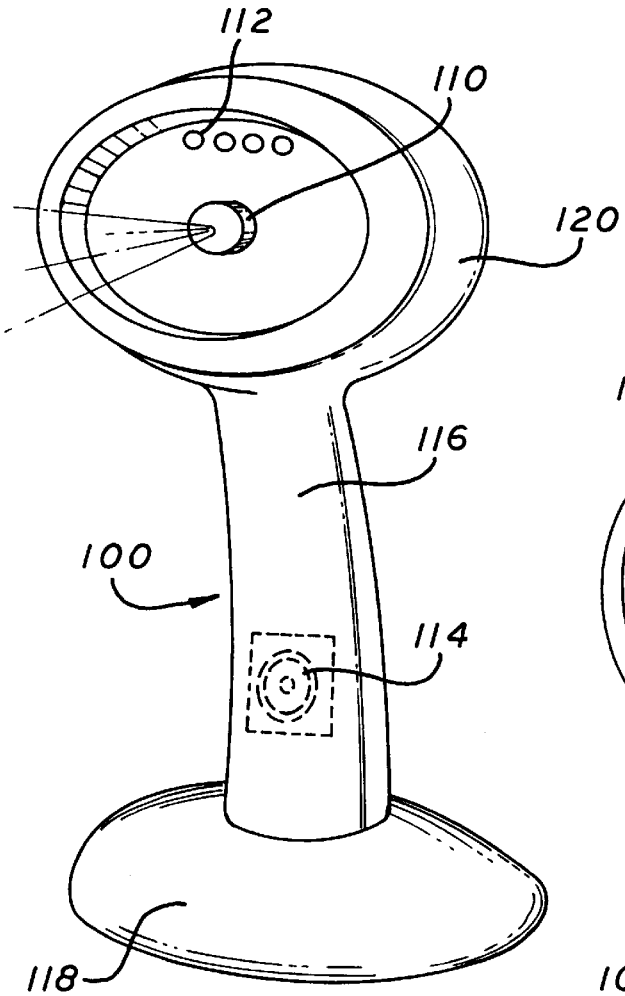
FIG. 3 is a front perspective view of a game unit of the present invention.
Figure 4:
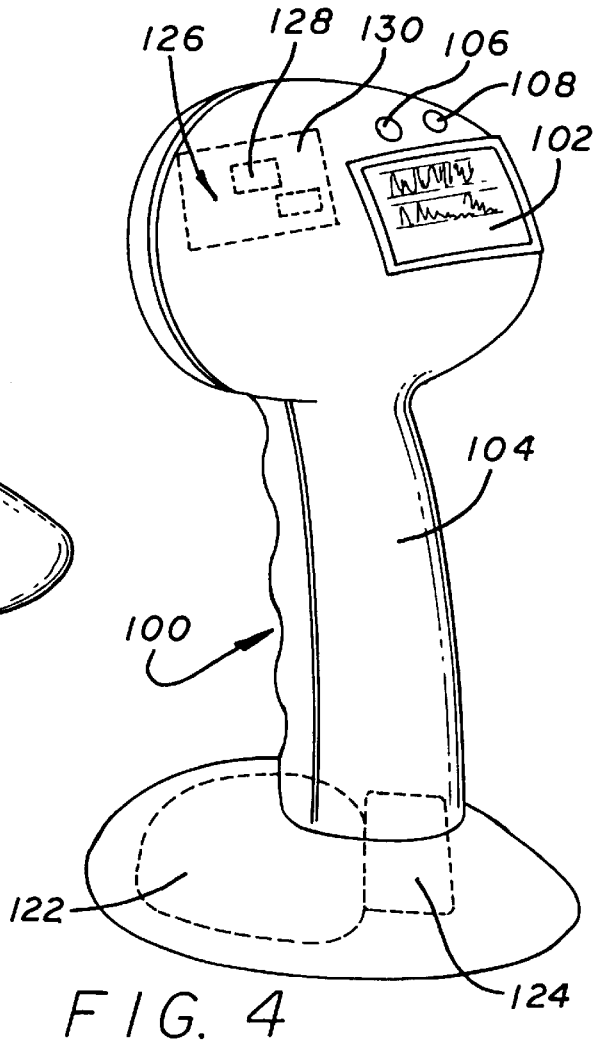
FIG. 4 is a rear perspective view of the game unit.

FIGS. 3 and 4 show an embodiment of a game set 100 of the present invention. The game set 100 may include a visual display 102 that is attached to a housing 104. The visual display 102 may contain an array of light emitting diodes (LEDs) which provide alphanumeric messages. The visual display 102 may be located adjacent to a pair of input switches 106 and 108 which can be depressed by a player.

A spray nozzle 110 may be attached to the housing 104. A fluid such as water may be discharged from the nozzle 110. The nozzle 110 may be located adjacent to a plurality of indicators 112 and a speaker 114. The indicators 112 may be LEDs which flash to indicate that a timer is counting down. The speaker 114 may be used to generate audible sounds such as question that is provided to the players of the game.

The housing 104 may have a handle portion 116 that can be easily grasped by a player. The handle portion 116 may extend from a base portion 118 which allows the game set 100 to be placed on a surface such as a table. A head portion 120 may extend from the handle portion 116.

A fluid reservoir 122 may be located within the base portion 118. The fluid reservoir 122 may be filled with a fluid such as water through a sealable port (not shown). A pumping mechanism 124 may be connected to the fluid reservoir 122 and the nozzle 110. The pumping mechanism 124 may be actuated into a discharge state so that the mechanism pumps fluid from the reservoir 122 to the nozzle 110. The pumping mechanism 124 may be similar to the mechanism shown in FIG. 2, except that the piston 38 may be driven by a solenoid (not shown). Although a reservoir 122 is shown and described, it is to be understood that the housing 104 may have an adapter to couple the pumping mechanism 124 to an external hose which provides the fluid.

The head portion 120 may include a printed circuit board assembly 126 that is connected to the visual display 102, switches 106 and 108, indicators 112, speaker 114 and pumping mechanism 124. The assembly 126 may include integrated circuits (not shown) which are located within packages 128 that are connected to a printed circuit board 130.

Figure 5:
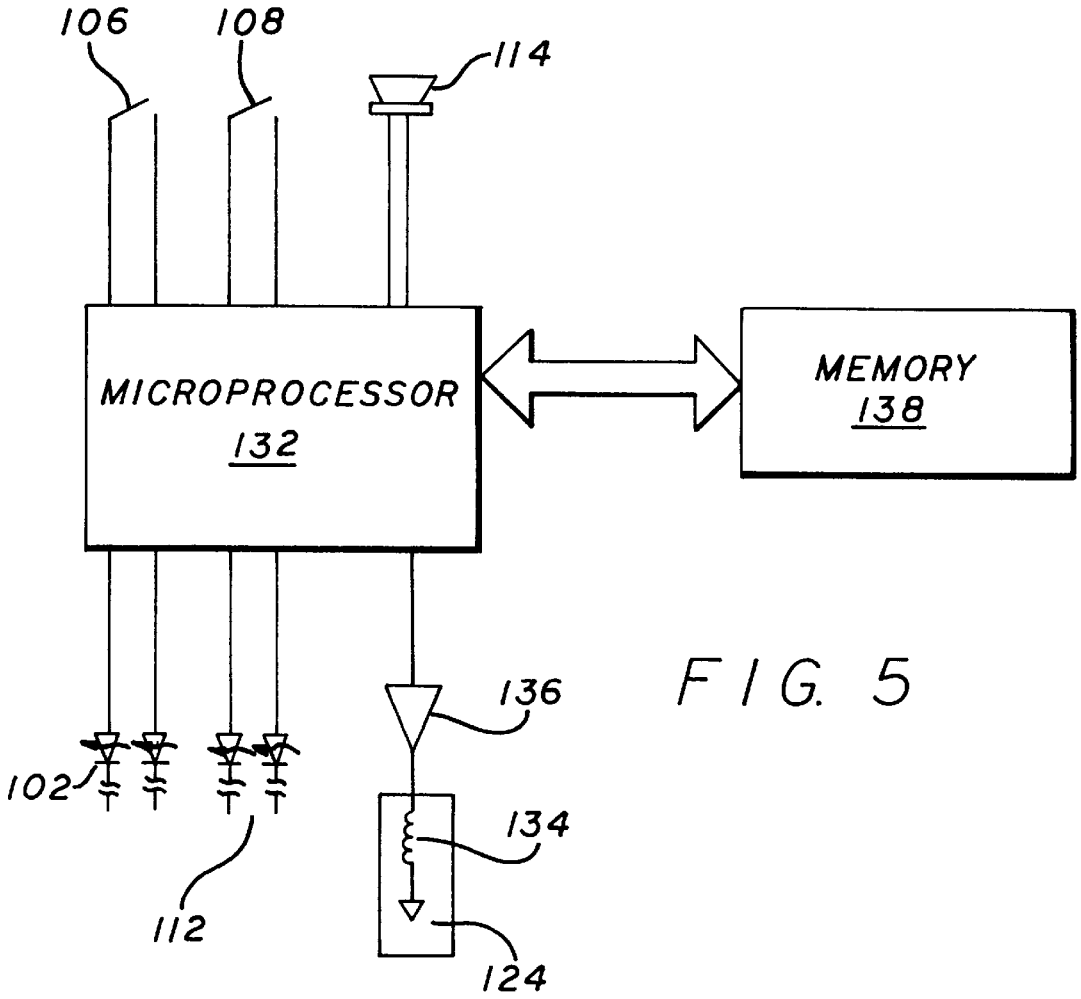
FIG. 5 is a schematic of an electrical system for the game unit.

FIG. 5 shows a schematic of an electrical system of the game set. The system may include a microprocessor 132 based controller circuit which is connected to the visual display 102, the switches 106 and 108, the indicators 112, the speaker 114 and a solenoid 134 of the pumping mechanism 124. The system may have a driver 136 connected to an output pin(s) of the microprocessor 132 and the solenoid 134 of the pumping mechanism 124.

The system may also include memory 138 that is connected to the microprocessor 132. Memory 138 may include both volatile memory devices such as dynamic random access memory (DRAM) devices and non-volatile devices such as read only memory (ROM) devices. The ROM memory may contain instructions and data that are used by the microprocessor 132 to perform software routines. The system may also have a power on switch (not shown) and a power source (not shown) such as batteries. The game set 10 may also include a plug in memory module (not shown) which contains additional questions.

In operation, when a player turns the system on, the microprocessor 132 may provide an initial visual message on the visual display such as "How many players?". The player may enter the number of players through the switch 106. The input may be stored in memory 138 and utilized by the software routine of the microprocessor 132.

The microprocessor 132 may then display subsequent queries such as subject categories and degrees of difficulty which can be answered by the player. The microprocessor 132 eventually generates a question which is to be answered by the other players of the game. The queries, messages and questions may also be generated in audible form through the speaker 114. The microprocessor 132 may have a speech synthesis routine to generate the speech. Alternatively, the game set may include a separate speech synthesizer chip to generate speech. Although a visual display is shown and described, it is to be understood that the game set may only have a speaker. Likewise, the game set may only have the visual display and not include a speaker.

The generation of a question may also initiate a timer which counts to a time interval. The timer may be a count routine performed by the microprocessor 132. Alternatively, the timer may be a separate circuit.

The player holding the game set points the nozzle 110 at another player and provides the question. If the player answers the question correctly the player holding the game set presses switch 108 which resets the timer. The nozzle 110 is then pointed at a second player who must provide a correct answer.

The second player may have to provide a different correct answer to the same question. By way of example, the question may be to name a car company. The first player may state "Chevrolet". The second player must provide a car company other than Chevrolet. Each subsequent player is therefore provided with a more difficult task of correctly answering the question without repeating an earlier answer. Additionally, the indicator 112 and possibly the speaker 114 may be providing visual and audio indications that the timer is running out of time, further adding tension to the game.

If a player does not correctly answer a question within the time interval the microprocessor 132 may actuate the pumping mechanism 124 into the discharge state so that the player is sprayed with fluid from the nozzle 110. The microprocessor 132 may generate a new question if everyone provides a correct answer or someone is sprayed with the fluid. The person that is sprayed may then hold the game set and point the nozzle at the other players.

What is claimed is:

1. An electronic water game, comprising:

a housing;

a spray unit that is coupled to said housing and can be actuated into a discharge state;

a visual display that is attached to said housing; and, a controller circuit which can provide at least one question to said visual display and can actuate said spray unit into said discharge state.

2. The game as recited in claim 1, further comprising a reset switch that can be actuated to reset a timer of said controller circuit, wherein said controller circuit actuates said spray unit into said discharge state if said reset switch is not actuated within a time interval.

3. The game as recited in claim 2, wherein said visual display displays the question.

4. The game as recited in claim 3, further comprising a memory device which contains a plurality of questions.

5. The game as recited in claim 3, further comprising a speaker that is attached to said housing and connected to said controller circuit.

6. An electronic water game, comprising:

a housing;

a spray unit that is coupled to said housing and can be actuated into a discharge state;

a speaker that is attached to said housing; and, a controller circuit which can provide at least one question to said speaker and can actuate said spray unit into said discharge state.

7. The game as recited in claim 6, further comprising a reset switch that can be actuated to reset a timer of said controller circuit, wherein said controller circuit actuates said spray unit into said discharge state if said reset switch is not actuated within a time interval.

* * * * *